United States Patent [19]

Materna

[11] Patent Number: 4,809,621

[45] Date of Patent: Mar. 7, 1989

[54] REFRACTORY BRICK PROTECTION FOR MEMBRANE BOILER WALLS

[75] Inventor: William R. Materna, Dubuque, Iowa

[73] Assignee: Merkle Engineers, Inc., Galena, Ill.

[21] Appl. No.: 181,382

[22] Filed: Apr. 14, 1988

[51] Int. Cl.[4] ..... F23M 9/00

[52] U.S. Cl. ..... 110/323; 110/325; 110/336; 122/235 A

[58] Field of Search ..... 110/322, 323, 324, 325, 110/331, 332, 336, 337; 122/510, 511, 512, 235 A

[56] References Cited

U.S. PATENT DOCUMENTS

| | | | |
|---|---|---|---|
| 1,202,386 | 10/1916 | Hitchcock . | |
| 1,774,150 | 8/1930 | Murray | 122/235 A |
| 1,775,414 | 9/1930 | Tone . | |
| 1,876,301 | 9/1932 | Johnson | 110/325 |
| 2,099,829 | 11/1937 | Smith | 122/235 A |
| 2,167,901 | 8/1939 | Murray, Jr. . | |
| 2,276,025 | 3/1942 | Davey | 110/325 |
| 2,734,259 | 2/1956 | Beck | 29/157.3 |
| 3,448,798 | 6/1969 | Coe | 165/168 |
| 3,797,416 | 3/1974 | Lawsen | 110/324 |
| 3,992,835 | 11/1976 | Saveker | 165/170 |

*Primary Examiner*—Steven E. Warner

*Attorney, Agent, or Firm*—Thomas W. Speckman

[57] ABSTRACT

Refractory bricks, suspended wall of refractory bricks, and a method for mounting refractory bricks for protection of membrane boiler tube walls. The pre-fired brick has a rectangular generally flat exterior face, a top face having an upper groove extending across the top face generally parallel to the exterior face, a bottom face having a lower groove extending across the bottom face generally parallel to the exterior face, the upper groove being deeper than the lower groove, the upper and lower grooves sized and spaced to accommodate mounting bars attached to the membrane boiler tube wall.

13 Claims, 2 Drawing Sheets

REFRACTORY BRICK PROTECTION FOR MEMBRANE BOILER WALLS

BACKGROUND OF THE INVENTION

1. Field of the Invention

This invention relates to refractory bricks used to protect membrane boiler tubes, a suspended wall of such refractory bricks, and to a method for mounting refractory bricks used to protect membrane boiler tubes.

2. Description of the Prior Art

Boiler designs have boiler tubes running parallel at a predetermined distance from each other to carry liquids to be heated by the combustion within the boiler. Membrane boilers have a fin welded between adjacent boiler tubes resulting in an air-tight sealed enclosure. It is desirable in modern boiler design to have membrane boiler tube protection. In membrane boilers the welded fins prevent installation of refractory material which locks around the inside periphery of the boiler tube.

Murray, Jr., U.S. Pat. No. 2,167,901 teaches a boiler wall formed by tubes having high thermal conducting fins extending outward and substantially closing the space between the boiler tubes. The '901 patent teaches a furnace wall constructed of shaped refractories grouted in place or held in place by a plastic insulation outer layer and metal shell. The '901 patent does not teach a method for individually replacing refractories, nor does it teach any type of refractory suspension system.

Several patents teach methods for attaching refractories to furnace wall structures which have spaces open between the boiler tubes. Hitchcock, U.S. Pat. No. 1,202,386, teaches a method for installing mortise and tenon bricks between open boiler tubes. Tone, U.S. Pat. No. 1,775,414, Davey, U.S. Pat. No. 2,276,025, and Johnson, U.S. Pat. No. 1,876,301 teach refractories which interlock through spaces between the boiler tubes and depend upon access to more than one-half the peripheral surface of the boiler tubes.

Beck, U.S. Pat. No. 2,734,259 and Coe, U.S. Pat. No. 3,448,798 teach heat exchangers which provide improved thermal exchange from the tubes through the use of high thermal conductivity in association with the tubes. Saveker, U.S. Pat. No. 3,992,835, teaches improved core members suitable for use in composite structural elements.

Prior refractory designs which protect boiler tubes date back many decades. However, such designs do not accommodate the configurations of membrane-type boilers. Prior refractory designs can be used on boilers having an open space between the boiler tubes. In such prior designs, he refractory bricks fit into place through the open space and lock in back of the boiler tubes. Membrane-type boilers have no open spaces between the boiler tubes, therefore, such boilers do not accommodate prior refractory designs.

One established method for applying protection to membrane boiler tubes uses monolithic materials. A plurality of studs welded to the boiler tubes and fin membranes act as anchors to hold either gunned or trowelled into place monolithic materials. However, monolithic materials have proven unsatisfactory for adequate boiler tube protection. In contrast with monolithic materials, pre-fired refractory products such as refractory bricks have greater density, provide better heat transfer to the boiler tubes, have better resistance to slag adhesions, have better resistance to erosion, and unlike monolithic materials, require no curing in the field.

Other prior designs used to apply pre-fired refractory bricks to a membrane boiler use a threaded stud, welded to the boiler tube or fin membrane, and a refractory brick having a through hole. The threaded stud extends through the hole in the brick and a nut fastens on the threaded stud to hold the brick in place. A brick with a through hole causes difficulties such as heat loss and erosion. Another prior design uses two bars welded to and extending angularly upwardly and outwardly from the membrane fin of the boiler wall. Refractory bricks used in such design have matching upwardly and outwardly angled recesses in the face of the refractory brick. The angled recesses allow the refractory bricks to slide onto the two bars extending from the boiler wall. Such design requires critical placement of the two bars for proper support. In addition, the refractory bricks do not interlock in place nor can they be individually replaced.

SUMMARY OF THE INVENTION

It is an object of this invention to provide a refractory suitable for suspended mounting on a membrane boiler tube wall.

Another object of this invention is to provide a method for refractory brick protection of membrane boiler tube walls.

It is yet another object of this invention to provide a membrane boiler suspended refractory brick wall in which refractory bricks can be individually replaced.

Pre-fired refractory products such as refractory bricks, have properties superior to those of monolithic materials used in the past for membrane boiler protection. Pre-fired bricks according to this invention have a rectangular generally flat exterior face, a top face having an upper groove extending across the top face generally parallel to the exterior face, a bottom face having a lower groove extending across the bottom face generally parallel to the exterior face, the upper groove being deeper than the lower groove, the grooves being sized and spaced to accommodate mounting bars. A suspended protective wall of refractories of this invention has mounting bars attached to the exterior wall of a fin tube boiler and spaced to fit the upper and lower grooves of the above described refractory bricks. The refractory bricks are mounted by placing a brick into position with a mounting bar inserted into its upper groove sufficiently far to allow the bottom face to clear the top of the next adjacent lower mounting bar, aligning the lower groove of the brick with the next adjacent lower mounting bar, and allowing the brick to drop into place with the lower mounting bar inserted into the lower groove of the brick while the upper mounting bar still retains the top of the brick positioning by being within the upper groove of the brick. The bricks are thereby locked into position in a manner allowing replacement of individual bricks. In a curtain wall of a plurality of bricks the lower grooves of an upper row of bricks engages the upper portion of a mounting bar while the upper grooves of an adjacent lower row of bricks engages the lower portion of the same mounting bar. While the terminology "upper" and "lower" is used throughout this description and claims, it should be appreciated that these terms apply to generally vertical side and end walls but should not limit the invention.

It is readily apparent that the protective wall can, in the same manner, be applied to generally horizontal surfaces, such as the top of a furnace. Refractory bricks according to this invention offer better material properties and can be attached to new or existing membrane boiler tube walls.

BRIEF DESCRIPTION OF THE DRAWINGS

The above objects and further advantages of this invention will become apparent by reference to the following description of preferred embodiments taken in conjunction with the drawing, wherein.

DESCRIPTION OF THE PREFERRED EMBODIMENTS

Figure 1:
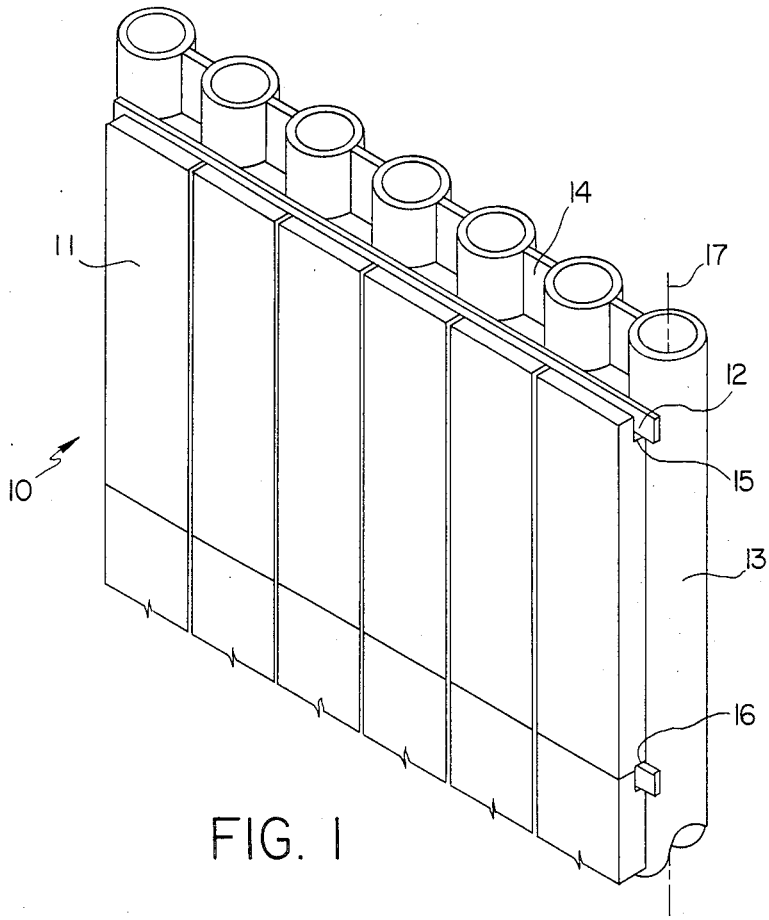
FIG. 1 shows a perspective view of membrane boiler tubes having a plurality of refractories connected according to one embodiment of this invention.

FIG. 1 shows a perspective view of suspended wall 10 having a plurality of aligned refractory bricks 11, according to one embodiment of this invention, mounted to a membrane boiler wall composed of tubes 13 joined by fin membranes 14. Each fin membrane 14 is welded between opposing surfaces of two boiler tubes 13 in a plane of the tube centerlines 17. The membrane boiler wall having fin membranes 14 welded between boiler tubes 13 results in an air-tight boiler wall.

Figure 5:
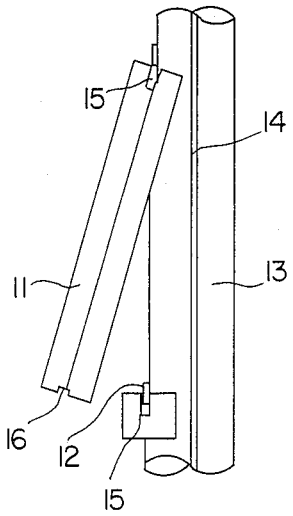
FIG. 5 shows a side view of the first step used to mount a refractory brick, according to one embodiment of this invention, to a set of boiler tubes.
Figure 6:
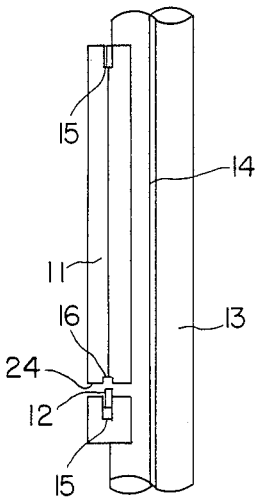
FIG. 6 shows a side view of the second step used to mount a refractory brick, according to one embodiment of this invention, to a set of boiler tubes.
Figure 7:
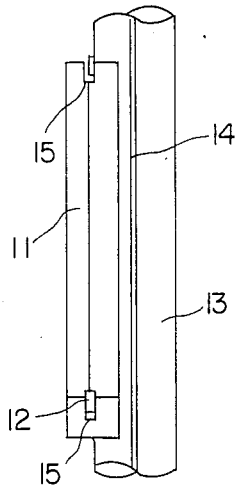
FIG. 7 shows a side view of the third step used to mount a refractory brick, according to one embodiment of this invention, to a set of boiler tubes.

Mounting bar 12 is attached to and may set outwardly from boiler tubes 13. Refractory brick 11 has a top face 23 with upper groove 15 extending across the top face generally parallel to exterior face 25 and a bottom face 24 with lower groove 16 extending across the bottom face generally aligned with upper groove 15. Upper groove 15 forms a recess in the top of refractory brick 11 deeper than the recess that lower groove 16 forms in the bottom of refractory brick 11. Thus, the top portion of refractory brick 11 can be positioned below an upper mounting bar 12 and slid upwardly with the bottom of the upper mounting bar entering upper groove 15 until the bottom face 24 of refractory brick 11 clears the top of lower mounting bar 12. Then the lower portion of refractory brick 11 can be positioned toward boiler tube 13 aligning lower groove 16 with lower mounting bar 12 and refractory brick 11 slid downward to lock itself into position on both the upper and lower mounting bars 12 for that particular row of refractory bricks, as shown in FIGS. 5, 6 and 7.

Figure 3:
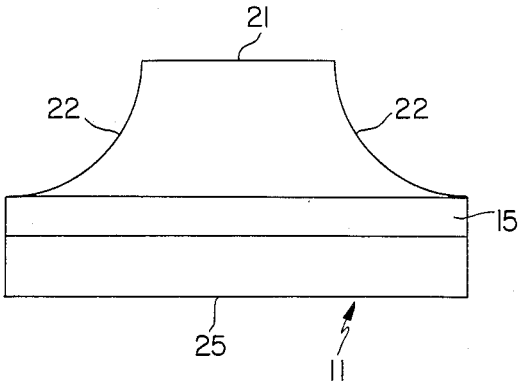
FIG. 3 shows a top view of the refractory brick of FIG. 2.
Figure 2:
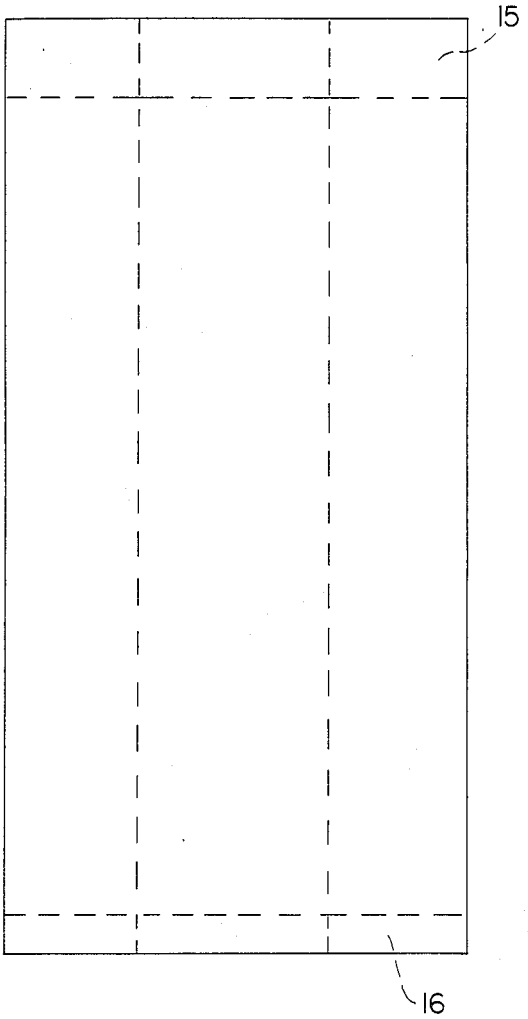
FIG. 2 shows a front view of a refractory brick according to one embodiment of this invention.
Figure 4:
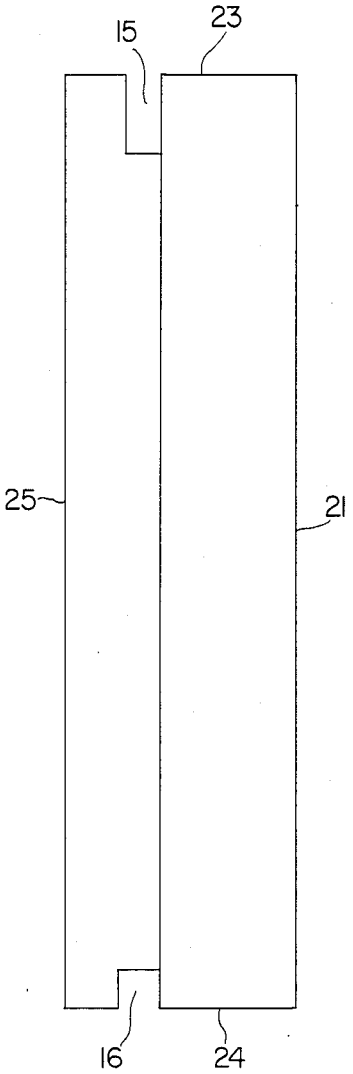
FIG. 4 shows a side view of the refractory brick of FIG. 2.

FIGS. 2, 3 and 4 show the front, top and side views, respectively, of a refractory brick 11 according to one embodiment of this invention. In the installed position of refractory brick 11, interior face 21 abuts or sets near the flat surface of fin membrane 4. Tube conforming face 22 follows the outer contour of boiler tubes 13. In other embodiments of this invention, interior face 21 and tube conforming face 12 can have various geometric configurations which may or may not fit adjacent other boiler tube designs. For example, in those services where studs have been welded onto the outer surface of boiler tube 13 and/or fin membrane 14 to act as anchors for monolithic materials, interior face 21 and tube conforming face 22 can have recesses shaped to fit over regularly spaced existing studs or hangers for other wall systems.

A pre-fired brick according to this invention may have an interior face of which a portion is generally flat to fit adjacent the membrane portion of the furnace wall and a portion is curved to fit adjacent the tube portion of the wall. The flat interior face portion may be generally centered between two curved portions or the curved portion may be generally centered between two flat face portions. In yet another embodiment of this invention, refractory brick 11 may have a flat interior face extending entirely across the interior face of the refractory brick. In this case, mounting bar 12 can be spaced outward from boiler tubes 13 at a distance greater than the length of any existing studs or hangers. Such mounting will fit over any existing welded studs or hangers and thus eliminates any need for removing and grinding existing welded studs. This embodiment also permits easy repair of monolithic coverings using the refractories and suspension system of this invention.

It is apparent that the refractory bricks for use in this invention may be constructed in a large variety of sizes suitable for use in a large number of installations according to this invention. The size of the brick forms no part of the invention other than the brick mating with the spaced mounting bars on the exterior of the membrane boiler walls. It is preferred that the adjacent side walls of the bricks according to this invention be flat so that individual bricks may be replaced. The refractory bricks according to this invention may be of a wide variety of chemical compositions and may be formulated according to any refractory brick composition as known to the art. Likewise, the mounting bars may be fabricated in a wide variety of sizes and materials as will be readily apparent to one skilled in the art. The mounting bars may be fastened to the membrane boiler wall by any suitable method such as welding or by any type of bracket which does not interfere with use of the mounting bar as described above.

A suspended pre-fired brick wall for protecting a membrane boiler tube wall according to this invention has a plurality of spaced mounting bars attached generally horizontally to the exterior of the membrane boiler tube wall and a plurality of pre-fired bricks locked into side-by-side position on adjacent mounting bars substantially filling the space between the adjacent mounting bars and forming a row of bricks, each brick being an elongated brick having a rectangular generally flat exterior face, a top face having an upper groove extending across the top face generally parallel to the exterior face, a bottom face having a lower groove extending across the bottom face generally parallel to the exterior face, the upper groove being deeper than the lower groove, the upper and lower grooves being sized and spaced to accommodate the mounting bars, the upper groove engaging the upper of the adjacent mounting bars and the lower groove engaging the lower of the adjacent bars, thereby locking each brick into position.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A pre-fired brick for protecting membrane boiler tube walls comprising: an elongated brick having a rectangular generally flat exterior face, a top face having an upper groove extending across said top face generally parallel to said exterior face, a bottom face having a lower groove extending across said bottom face generally parallel to said exterior face, said upper groove being deeper than said lower groove, said upper and lower grooves being sized and spaced to accommodate mounting bars attached to said membrane boiler tube walls.

2. A pre-fired brick according to claim 1 wherein said brick has an interior face flat portion extending across the entire width of said interior face.

3. A pre-fired brick according to claim 1 wherein said brick has an interior face a portion of which is generally flat to fit adjacent the membrane portion of said walls and a curved portion to fit adjacent the tube portion of said walls.

4. A pre-fired brick according to claim 3 having said interior face curved portion generally centered between two said flat face portions.

5. A pre-fired brick according to claim 3 wherein said flat interior face portion is generally centered between two of said curved portions.

6. A suspended pre-fired brick wall for protecting a membrane boiler tube wall comprising:

a plurality of spaced mounting bars attached generally horizontally to the exterior of said membrane boiler tube wall;

plurality of pre-fired bricks locked into side-by-side position on adjacent said mounting bars substantially filling the space between said adjacent mounting bars and forming a row of said bricks, each said brick being an elongated brick having a rectangular generally flat exterior face, a top face having an upper groove extending across said top face generally parallel to said exterior face, said upper groove being deeper than said lower groove, said upper and lower grooves being sized and spaced to accommodate said mounting bars, said upper groove engaging the upper said adjacent mounting bar and said lower groove engaging the lower said adjacent mounting bar thereby locking each said brick into position.

7. A suspended brick wall according to claim 6 wherein each said brick has an interior face a portion of which is generally flat to fit adjacent the membrane portion of said walls and a curved portion to fit adjacent the tube portion of said walls.

8. A suspended brick wall according to claim 7 wherein said flat interior face portion is generally centered between two of said curved portions.

9. A suspended brick wall according to claim 7 having said interior face curved portion generally centered between two said flat face portions.

10. A suspended brick wall according to claim 6 wherein said brick has an interior face flat portion extending across the entire width of said interior face.

11. A suspended brick wall according to claim 6 wherein said mounting bars are attached directly to the exterior of tubes of said membrane boiler tube wall.

12. A suspended brick wall according to claim 6 wherein said mounting bars are spaced outwardly from the exterior of tubes of said membrane boiler tube wall.

13. A method of installing pre-fired brick for protection of membrane boiler tube walls, said method comprising:

positioning the upper portion of an elongated brick having a rectangular generally flat exterior face, a top face having an upper groove extending across said top face generally parallel to said exterior face, a bottom face having a lower groove extending across said bottom face generally parallel to said exterior face, said upper groove being deeper than said lower groove, said upper and lower grooves being sized and spaced to accommodate mounting bars attached to said membrane boiler tube walls, in position so that an upper said mounting bar enters said upper groove;

sliding said brick upwardly until said bottom face clears the top of an adjacent lower said mounting bar;

positioning the lower portion of said brick aligning said lower groove with said lower mounting bar;

moving said brick downwardly to lock it into position on both said upper and lower mounting bars.

* * * * *